US007417375B2

(12) United States Patent
Muto et al.

(10) Patent No.: US 7,417,375 B2
(45) Date of Patent: Aug. 26, 2008

(54) MERCURY FREE METAL HALIDE LAMP

(75) Inventors: Masaaki Muto, Tokyo (JP); Shinya Omori, Tokyo (JP)

(73) Assignee: Stanley Electric Co., Ltd., Tokyo (JP)

( * ) Notice: Subject to any disclaimer, the term of this patent is extended or adjusted under 35 U.S.C. 154(b) by 107 days.

(21) Appl. No.: 11/234,168

(22) Filed: Sep. 26, 2005

(65) Prior Publication Data

US 2006/0066243 A1 Mar. 30, 2006

(30) Foreign Application Priority Data

Sep. 27, 2004 (JP) ..... 2004-279647

(51) Int. Cl.
*H01J 17/20* (2006.01)
*H01J 61/18* (2006.01)

(52) U.S. Cl. ..... 313/638; 313/484; 313/637; 313/567

(58) Field of Classification Search ..... 313/484, 313/567, 568, 637, 638, 643
See application file for complete search history.

(56) References Cited

U.S. PATENT DOCUMENTS 6,069,456 A * 5/2000 Fromm et al. ..... 315/248
6,265,827 B1 * 7/2001 Takahashi et al. ..... 313/638
6,653,801 B1 * 11/2003 Takeda et al. ..... 315/246
2004/0256991 A1 * 12/2004 Minamihata et al. ..... 313/626

FOREIGN PATENT DOCUMENTS

| | | |
|---|---|---|
| JP | 3-152852 | 6/1991 |
| JP | 90120800 | 5/1997 |
| JP | 2000-90880 | 3/2000 |

* cited by examiner

*Primary Examiner*—Toan Ton
*Assistant Examiner*—Kevin Quarterman
(74) *Attorney, Agent, or Firm*—Cermack Kenealy & Vaidya LLP

(57) ABSTRACT

In a metal halide lamp, xenon gas having a pressure of at least 3 atmospheres at room temperature and at least a metal halide including indium iodide are sealed in a discharge space not containing mercury. If the volume of the discharge space is denoted by V ($mm^3$), the electric power applied to the arc tube by P (W), and the weight of the indium iodide by X (μg), these parameters are set so as to satisfy a relationship $(P/V)(X/V)^{0.2}>3.0$. A continuous emission spectrum can thereby be produced by indium over the entire visible wavelength range, thus obtaining a mercury-free metal halide lamp that is usable as an excellent white light source suitable for data projectors, automobile lamps, headlights, and other systems and devices.

18 Claims, 3 Drawing Sheets

| Indium Iodide Density (X/V) [μg/mm³] | 1.2 | 1.4 | 1.6 | 1.8 | 2 | 2.2 | 2.4 |
|---|---|---|---|---|---|---|---|
| 60 | 41.0<br>13100<br>2.72 | 48.5<br>8484<br>3.18 | 54.4<br>6323<br>3.63 | 56.6<br>5079<br>4.08 | 55.2<br>4308<br>4.54 | 52.5<br>3940<br>4.99 | 50.3<br>3750<br>5.44 |
| 40 | 40.5<br>14510<br>2.51 | 48.3<br>9462<br>2.93 | 54.9<br>6676<br>3.35 | 58.8<br>5386<br>3.76 | 59.7<br>4632<br>4.18 | 58.7<br>4150<br>4.60 | 56.2<br>3890<br>5.02 |
| 20 | 36.3<br>22700<br>2.18 | 43.7<br>14200<br>2.55 | 50.1<br>8479<br>2.91 | 55.4<br>6451<br>3.28 | 58.4<br>5462<br>3.64 | 59.1<br>4950<br>4.01 | 58.3<br>4660<br>4.37 |
| 8 | 31.5<br>Impossible<br>1.82 | 36.8<br>2.12 | 41.2<br>21500<br>2.43 | 44.7<br>12900<br>2.73 | 47.3<br>8020<br>3.03 | 49.0<br>6450<br>3.33 | 49.8<br>5970<br>3.64 |

Fig. 5

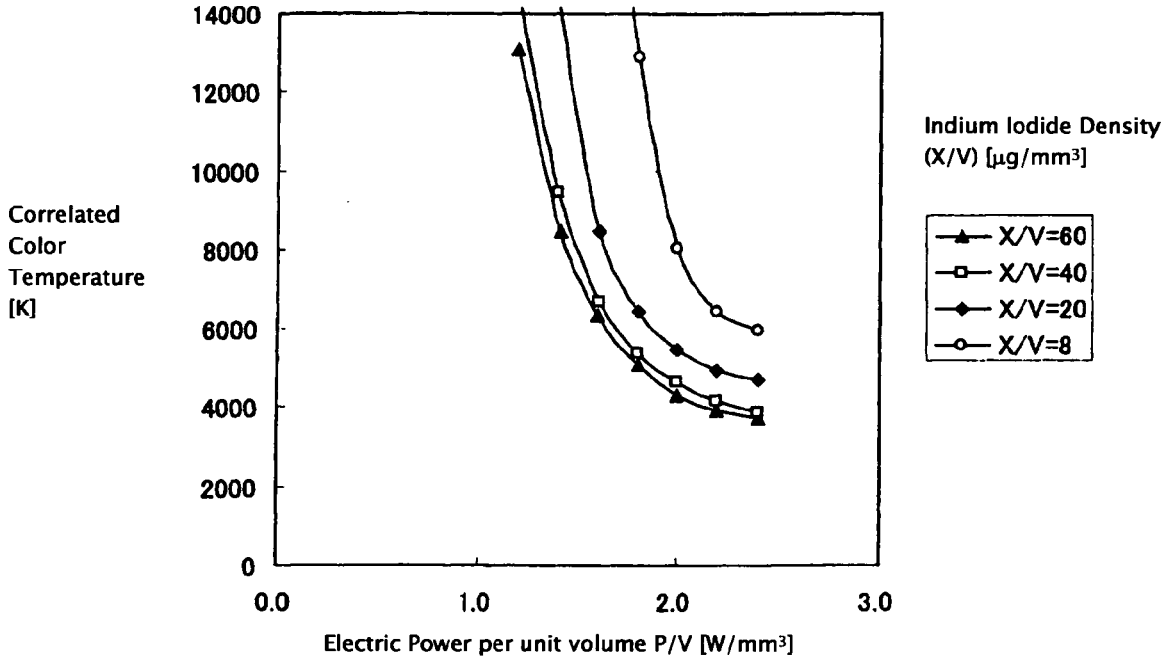

Fig. 6

Lamp Efficiency [lm/W]
Correlated Color Temperature [K]
$(P/V)(X/V)^{0.2}$

Section 601 Section 602 Section 603

| Indium Iodide Density (X/V) [μg/mm³] | | | | | | | |
|---|---|---|---|---|---|---|---|
| 60 | 41.0<br>13100<br>2.72 | 48.5<br>8484<br>3.18 | 54.4<br>6323<br>3.63 | 56.6<br>5079<br>4.08 | 55.2<br>4308<br>4.54 | 52.5<br>3940<br>4.99 | 50.3<br>3750<br>5.44 |
| 40 | 40.5<br>14510<br>2.51 | 48.3<br>9462<br>2.93 | 54.9<br>6676<br>3.35 | 58.8<br>5386<br>3.76 | 59.7<br>4632<br>4.18 | 58.7<br>4150<br>4.60 | 56.2<br>3890<br>5.02 |
| 20 | 36.3<br>22700<br>2.18 | 43.7<br>14200<br>2.55 | 50.1<br>8479<br>2.91 | 55.4<br>6451<br>3.28 | 58.4<br>5462<br>3.64 | 59.1<br>4950<br>4.01 | 58.3<br>4680<br>4.37 |
| 8 | 31.5<br>Impossible<br>1.82 | 36.8<br>2.12 | 41.2<br>21500<br>2.43 | 44.7<br>12900<br>2.73 | 47.3<br>8020<br>3.03 | 49.0<br>6450<br>3.33 | 49.8<br>5970<br>3.64 |
| | 1.2 | 1.4 | 1.6 | 1.8 | 2 | 2.2 | 2.4 |

Electric Power per unit volume P/V [W/mm³]

MERCURY FREE METAL HALIDE LAMP

This application claims the priority benefit under 35 U.S.C. §119 of Japanese Patent Application No. 2004-279647 filed on Sep. 27, 2004, which is hereby incorporated in its entirety by reference.

BACKGROUND OF THE INVENTION

1. Field of the Invention

The invention relates to a light source. More particularly, the invention relates to light sources used in, for example, display systems for projecting images, such as data projectors, and automobile lamps, including headlamps, signal lamps, traffic lamps, etc.

2. Description of the Related Art

Currently, ultra-high pressure mercury lamps having high light collection efficiencies are mainly used in display systems for projecting images, such as data projectors. Recently, however, light sources that do not contain mercury are desired from the viewpoint of environmental protection and other reasons. In particular, light sources are desired that can be used in data projectors (and other systems), and which have a continuous emission spectrum in the visible Light range, a high light collection efficiency, a high lamp efficiency, and a long durability, and which do not contain mercury.

Japanese Patent Laid-Open Publications Nos. Hei 3-152852 and 2000-90880 each disclose a mercury-free metal halide lamp filled with a plurality of different kinds of metal halides and xenon gas. These mercury-free lamps can emit light having overlaid emission peaks corresponding to the different kinds of metal halides. In particular, Japanese Patent Laid-Open Publication No. 2000-90880 describes a mercury-free metal halide lamp using three kinds of halides of sodium, indium, and thallium. In this lamp, the respective amounts of these halides are set so that the absorption spectra of the sodium, indium, and thallium halides occur at 589 nm, 410 nm and 451 nm, and 535 nm, respectively. The mercury-free metal halide lamp exhibiting a continuous spectrum in the visible light range is thus obtained as shown in FIG. 2 in Japanese Patent Laid-Open Publication No. 2000-90880.

The technology disclosed in the specification of Japanese Patent No. 3196649 (corresponding to Japanese Patent Laid-Open Publication No. Hei 9-120800) proposes a mercury-free electrodeless discharge lamp. In this lamp, microwaves generated by a magnetron are guided through a waveguide tube to a rotating discharge bulb, so as to allow a metal halide and a noble gas, both filled in the discharge bulb, to emit light. Japanese Patent No. 3196649 also discloses that use of indium iodide as a metal halide filled in the discharge bulb can result in a continuous spectrum in the visible light range.

The metal halide lamps described in Japanese Patent Laid-Open Publications Nos. Hei 3-152852 and 2000-90880 are designed so as to obtain an emission spectrum by overlaying the emission spectrum peaks of the three kinds of halides. As a result, for example, the lamp disclosed in Japanese Patent Laid-Open Publication No. 2000-90880 provides a continuous spectrum in the visible light range. As is apparent from the spectrum distribution diagram disclosed in FIG. 2 in Japanese Patent Laid-Open Publication No. 2000-90880, however, the metal halide lamps emit light having three large intensity peaks around a blue wavelength of 450 nm, a green wavelength of 540 nm, and a wavelength of 590 nm. The intensities at these peaks are at least two times larger than the ones of other wavelengths. Further, the peak intensities around the green wavelength of 540 nm and the wavelength of 590 nm are at least 1.6 times larger than the peak intensity around the blue wavelength of 450 nm.

The metal halide lamp described in Japanese patent No. 3196649 (corresponding to JP 9-120800 A1) is a discharge lamp of an electrodeless type, in which microwaves generated by an external magnetron are guided through a waveguide tube to a discharge bulb. As described in paragraph No. 0003 of Japanese patent No. 3196649, this metal halide lamp easily couples electromagnetic energy with a halide in comparison to discharge lamps having electrodes (also referred to below as an electrode type), and therefore this type of lamp is easily made mercury-free. Furthermore, since this metal halide lamp has no electrodes, blackening in the discharge space does not occur. However, it is not easy to apply the halide used in the electrodeless type discharge lamp, which is disclosed in this publication, to electrode type discharge lamps. For this purpose, it is desired to solve the problems of coupling electromagnetic energy with halides and blackening in a discharge space.

SUMMARY OF THE INVENTION

In view of the foregoing and other problems and characteristics in the related art, in accordance with an aspect of the invention, a mercury-free white light source can be provided that has emission characteristics suitable for use in data projectors and other systems and devices.

According to another of the aspects of the invention, a mercury-free metal halide lamp can include: an arc tube having a discharge space thereinside; a pair of electrodes that project into the discharge space and face each other; and xenon gas having a pressure of at least 3 atmospheres at room temperature and at least a metal halide including indium iodide both sealed in the discharge space and not containing mercury. In this configuration, a relationship $(P/V)(X/V)^{0.2}>3.0$ is satisfied where the volume of the discharge space is denoted by V ($mm^3$), the electric power applied to the arc tube by P (W), and the weight of the indium iodide by X (μg). As a result, a continuous emission spectrum can be produced by indium over the entire visible wavelength range.

Satisfying the conditions of $1.6 \leqq (P/V) \leqq 2.4$ and $20 \leqq (X/V) \leqq 60$ can also be beneficial. This can achieve a lamp efficiency of 50 or more.

Satisfying the conditions of $1.8 \leqq (P/V) \leqq 2.4$, $20 \leqq (X/V) \leqq 40$, and $(P/V)(X/V)^{0.2}>3.6$ can be further beneficial. This can achieve a lamp efficiency of 58 or more.

BRIEF DESCRIPTION OF THE DRAWINGS

These and other aspects, benefits, characteristics and advantages of the invention will become clear from the following description with reference to the accompanying drawings, wherein:

FIG. 5 is a graph obtained by plotting correlated color temperatures against values for electric power per unit volume (P/V) for each indium iodide density (X/V) in the arc tube 1 of FIG. 1.

FIG. 6 illustrates the values of lamp efficiencies, correlated color temperatures, and quantities $(P/V)(X/V)^{0.2}$ when changing the combinations of the sealed indium iodide densities (X/V) and the electric power per unit volume (P/V) in the arc tube 1 of FIG. 1.

DETAILED DESCRIPTION OF PREFERRED EMBODIMENTS

Figure 1:
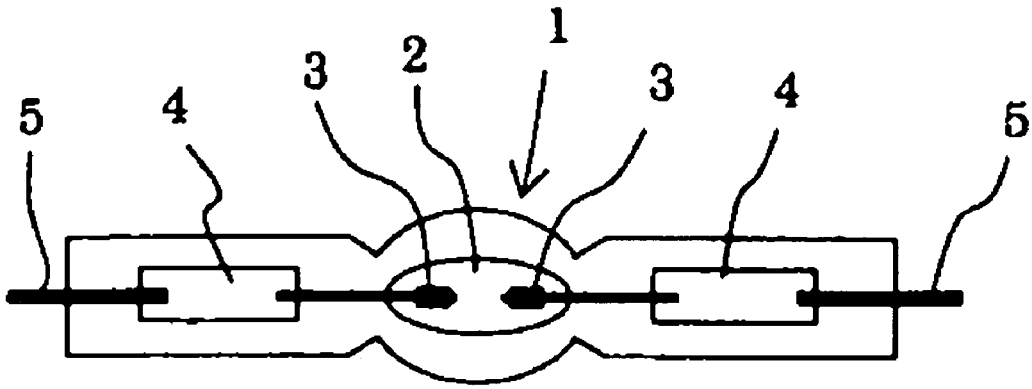
FIG. 1 is a side view illustrating an embodiment of a mercury-free metal halide lamp made in accordance with the principles of the invention.

A mercury-free metal halide lamp according to one embodiment of the invention will be described with reference to FIG. 1.

The mercury-free metal halide lamp according to the embodiment can include an arc tube 1 made of quartz glass, having a discharge space 2 inside, and a pair of electrodes 3. One end of the electrode 3 can project into the discharge space 2, and the other end can be buried in the quartz glass of the arc tube 1 and connected to a metal foil 4 by, for example, welding. The pair of electrodes 3 can be made of a high melting point metal such as, for example, tungsten. A lead wire 5 can be connected to the opposite side end of the metal foil 4 from the discharge space 2 by, for example, welding. The metal foil 4 and the lead wire 5 can be made of a material such as molybdenum and the like. The electrode 3 (excluding the part projecting into the interior of the discharge space 2), the entire metal foil 4, and a part of the lead wire 5 (at least including the connection part with the metal foil 4) may be buried in the quartz glass forming the arc tube 1 by means of a pinch seal or shrink seal, etc. The metal foils 4 and their peripheral members are thereby hermetically sealed, and at the same time, electrical connection via conduction to the electrodes 3 is made possible. The ends of the lead wires 5 projecting from the quartz glass at its respective ends can be connected through caps (not shown) to a driving power supply and receive electricity fed therefrom.

The discharge space 2 can be filled with xenon gas and indium iodide (InI). The xenon gas can not only serve as a starter gas for initiating discharge, but also as a buffer gas for forming a high temperature arc plasma to evaporate indium iodide. In the embodiment of FIG. 1, xenon gas can be sealed at a pressure of 3 atm or more in the discharge space 2, thereby evaporating indium iodide and obtaining prominent emissions from indium.

In accordance with another aspect of the invention, the amount of indium iodide (InI) can be determined so as to satisfy the condition given by the following equation (1). That is, when the volume of the discharge space 2 of the arc tube 1 is denoted by V (mm$^3$), the electric power supplied to the electrodes 3 by P (W), and the weight of indium iodide by X (μg), X is determined so as to satisfy the relationship described by the following equation (1).

$$(P/V)(X/N)^{0.2}>3.0 \quad (1)$$

A continuous emission spectrum produced by indium can thereby be obtained over the entire visible wavelength range.

Although the emission line spectrum of indium at 410 nm and 451 nm has been utilized in conventional metal halide lamps, the inventors have found through experiment that the indium emission in metal halide lamps of an electrode type can be extended over the entire visible wavelength range by satisfying the condition given by the above equation (1).

It has been known that if sufficient electric power is supplied by high density discharge to lamps employing a certain metal such as sodium and indium, an emission wavelength producing a line spectrum turns to an absorption wavelength and continuous spectrums are produced in the shorter and longer wavelength regions with respect to that wavelength. This phenomenon possibly occurs because as the interatomic distance decreases under a high density condition, a variation of the atomic potential structure occurs so that excitation potential fluctuates. High pressure sodium lamps, for example, utilize this phenomenon to produce wider continuous spectrums in the visible wavelength range. High pressure sodium lamps, however, are not generally acknowledged as a white lamp because they lack emission in the blue wavelength region, so the emission light takes on a slightly reddish color. Further, since metal sodium easily reacts with quartz glass, it is typical to use different materials for the arc tube, for example, to use a ceramic material such as alumina for the arc tube, causing a cost increase. Furthermore, since translucent ceramics such as alumina take on an opalescent color and the entire arc tube gleams while the lamp is on, the light source inevitably becomes large in size so that applying it to precise optical systems is difficult.

If indium is used as an emission material for metal halide lamps that are categorized as electrode type, it has been thought that a white lamp cannot be obtained (as in the high pressure sodium lamps) because emission in the blue region is predominant (in contrast to the high pressure sodium lamps). The inventors rejected this already established idea and succeeded in obtaining a white light source. Further, since sodium iodide hardly reacts with quartz glass, it has been confirmed that the light source can be made to be a substantially point light source by forming the arc tube 1 from quartz glass and reducing the distance between the electrodes.

The inventors checked the emission characteristics of the metal halide lamp shown in FIG. 1 while changing the amounts of xenon gas and indium iodide which are both sealed in the discharge space 2, while changing driving conditions, and while changing other conditions used as parameters during testing.

Figure 2:
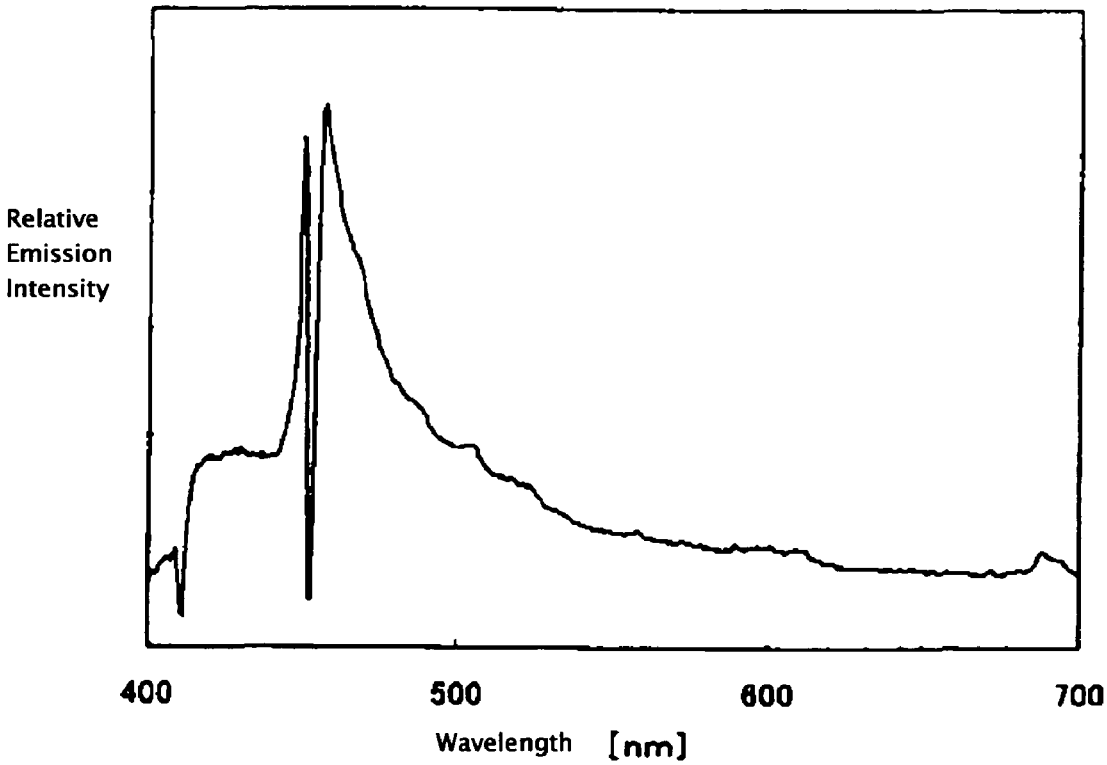
FIG. 2 is a graph illustrating an example of the emission spectrum distribution when indium iodide and xenon gas are sealed in the arc tube 1 of FIG. 1 and the pressure of the xenon gas is set to 3 atm or more.

When xenon gas was sealed at a pressure of 3 atm or more in the discharge space 2, indium iodide evaporated and prominent emission from indium occurred in the arc tube 1. FIG. 2 illustrates an example of the emission spectrum distribution when the pressure of xenon gas sealed in the arc tube is 3 atm or more. It is apparent from FIG. 2 that the emission, possibly produced by indium, extends over nearly the entire visible wavelength range. When an emission intensity distribution shows large peaks predominantly in shorter wavelengths like the example shown in FIG. 2, however, an actual emission takes on a strong blue color. Accordingly, this emission is not suitable for use in, for example, typical data projectors, automobile lamps and headlights, etc. Further, in the example shown in FIG. 2, lamp efficiency is as low as 37 lm/W, which may not be preferable from a power saving point of view.

Therefore, experiments were repeated to obtain a balanced emission spectrum and to improve the lamp efficiency. Specifically, experiments were conducted to obtain a lamp that has an appropriate emission spectrum in the visible wavelength range, which is suitable for use in data projectors and other systems and devices, and which meets a high lamp efficiency. A correlated color temperature of 10000 K or less and a lamp efficiency of 45 lm/W or more were set as the minimum value conditions. The values for the amount of indium iodide and the driving condition that enabled achievement of these conditions were then searched for.

As a result, the inventors found that there is a specific correlation among the volume of the discharge space in an arc tube, which is denoted by V ($mm^3$), the electric power applied to the arc tube, which is denoted by P (W), and the weight of indium iodide, which is denoted by X (fig). That is, it was found that the above correlated color temperature and lamp efficiency exceed the minimum levels if the relationship described by the following equation (1) is satisfied.

$$(P/V)(X/V)^{0.2}>3.0 \quad (1)$$

The details will be described below.

Figure 3:
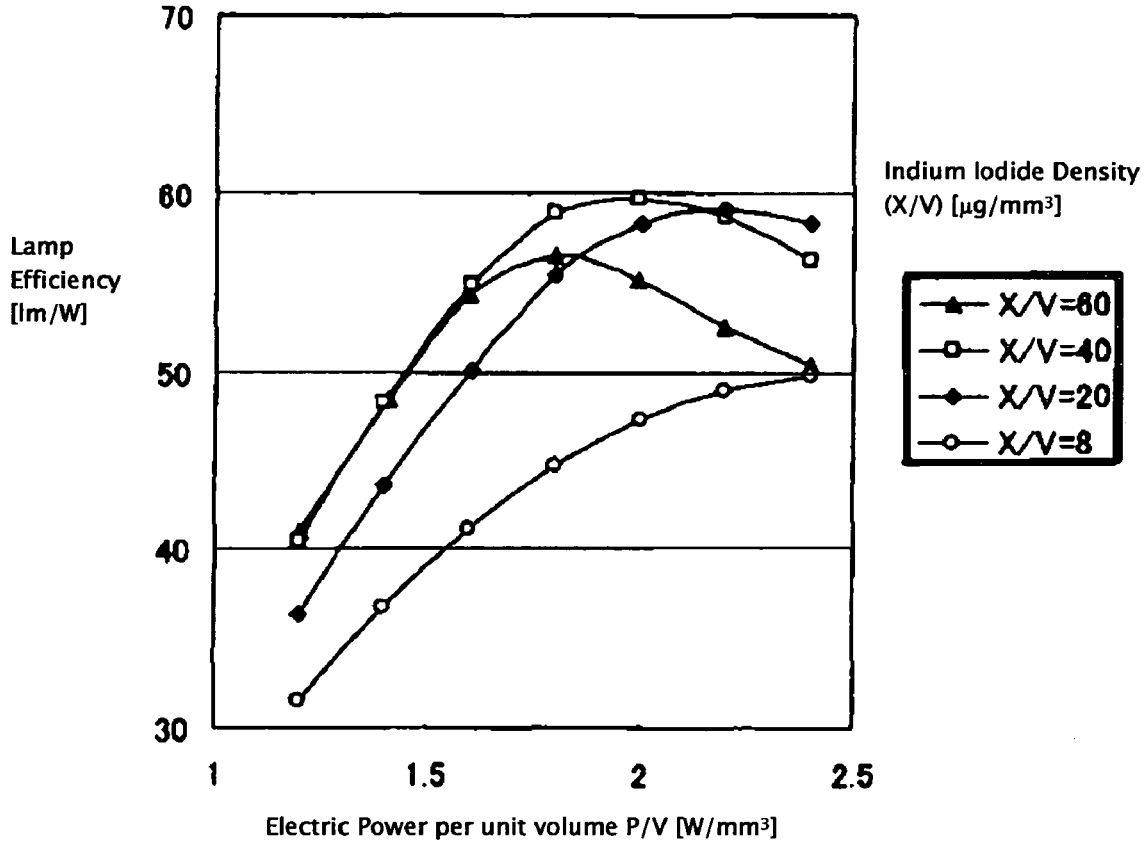
FIG. 3 is a graph obtained by plotting lamp efficiencies against values for electric power per unit volume (P/V) of the discharge space 2 for each indium iodide density (X/V) in the arc tube 1 of FIG. 1.

FIG. 3 is a graph obtained by plotting lamp efficiencies against electric power per unit volume (P/V) of the discharge space 2 for four arc tubes 1 each having different indium iodide densities (X/V). It is understood from FIG. 3 that the larger the indium iodide density (X/V) and the larger the electric power per unit volume (P/V), the more the lamp efficiency is improved, up until a certain peak.

Figure 4:
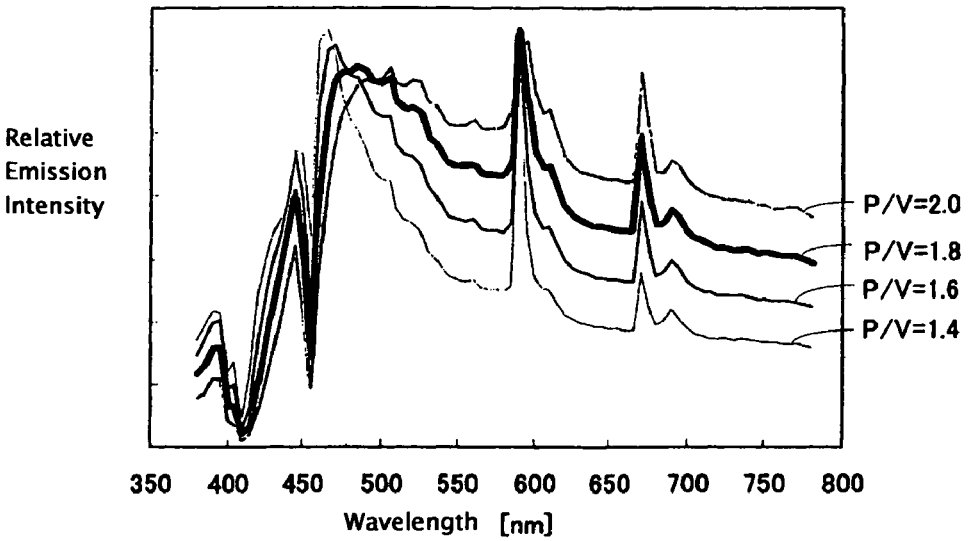
FIG. 4 is a graph illustrating the variations of emission spectrum distributions for different values of electric power per unit volume (P/V) when the indium iodide density (X/V) in the arc tube 1 of FIG. 1 is 40 μg/mm$^3$.

FIG. 4 is a graph showing the variations of emission spectrum distributions for four different values for electric power per unit volume (PV) when the indium iodide density (X/V) in the arc tube 1 is 40 $\mu g/mm^3$. It is understood from FIG. 4 that as the electric power per unit volume (P/V) is increased, the emission in the range of 500 nm to 600 nm that gives a high relative visibility is intensified so that a uniform emission spectrum is obtained in the visible range where the intensity distribution is small. It is also likely that the intensified emission in the range of 500 nm to 600 nm can achieve an improvement in the lamp efficiency and the reduction of correlated color temperature. At the same time, however, since the increase of electric power per unit volume (P/V) causes the increase of infrared radiation, it is conceivable that the lamp efficiency decreases from a certain point/stage, as shown in FIG. 3.

FIG. 5 is a graph obtained by plotting correlated color temperatures against electric power per unit volume (P/V) for four indium iodide densities (X/V). It is understood from FIG. 5 that as the electric power per unit volume (P/V) is increased, the correlated color temperature tends to decrease due to the variation of the emission spectrum balance. This tendency becomes prominent as the indium iodide density (X/V) is increased.

Therefore, as shown in the table of FIG. 6, lamp efficiencies, correlated color temperatures, and quantities $(P/V)(X/V)^2$ are checked by changing the combinations of indium iodide densities (X/V) and values for electric power per unit volume (P/V). In FIG. 6, as described in the explanatory notes, the numbers in the upper, middle, and lower rows indicate a lamp efficiency (lm/W), a correlated color temperature (K), and a quantity $(P/V)(X/V)^{0.2}$, respectively. The boxes located in section 601 are enclosed by a broken line and satisfy the condition $(P/V)(X/V)^{0.2}>3.0$ given by the equation (1) and meet the requirements of a lamp efficiency of 45 lm/W or more and a correlated color temperature of 10000 K or less. In addition, due to large P/V values in this section 601 (as understood from the variation tendency of the emission spectrum depending on the P/V values in FIG. 4), the difference between a peak light intensity and a light intensity between the peaks is small so that a substantially white emission distribution, in which the intensity distribution in the visible range depends less on the wavelength, can be obtained.

The boxes outside section 601 have values of $(P/V)(X/V)^{0.2}$ of 3.0 or less and for the most part do not meet the qualifications of a lamp efficiency of 45 lm/W or more, or a correlated color temperature of 10000 K or less. In addition, due to small P/v values outside section 601, light intensities between the peaks become small, resulting in an emission distribution in which the intensity distribution in the visible range strongly depends on wavelength, and thereby resulting in difficulty in obtaining an ideal white emission.

A lamp having a lamp efficiency of 45 lm/W or more and a correlated color temperature of 10000 K or less can thus be obtained by satisfying the condition $(P/V)(X/V)^{0.2}>3.0$. Since the lamp also takes on a substantially white emission in which the intensity distribution in the visible range depends less on wavelength, lamps suitable for use in various illumination applications can be provided.

In particular, section 602 which is enclosed by a thick line in FIG. 6, designates lamps that have values of P/V from 1.6 to 2.4 and values of X/V from 20 to 60. Lamps in section 602 may be beneficial because the lamp efficiencies exceed 50. A lamp efficiency exceeding 50 comes to a level equivalent to the lamp efficiencies of typical high-pressure discharge lamps of a high color rendering type. Therefore, lamps in section 602 according to this embodiment can be used in applications in which high rendering type high-pressure discharge lamps have typically been used. Further, section 603 designates lamps satisfying the condition $(P/V)(X/V)^{0.2}>3.6$, in which values of P/V are from 1.8 to 2.4 and values of X/V are from 20 to 40. Lamps of section 603 may be more beneficial because these lamp efficiencies typically exceed 58. A lamp efficiency exceeding 58 comes to a level equivalent to the lamp efficiencies of ultra-high pressure mercury lamps. Therefore, lamps in section 603 according to this embodiment can be used in applications in which ultra-high pressure mercury lamps have been typically used.

The mercury-free metal halide lamp of the embodiment has a driving electric power of 50 W, a lamp voltage of 35.9 V to 39.7 V, and a lamp current of 1.4 A or less which is equivalent to those of conventional metal halide lamps containing mercury. The evaporation of the electrodes 3 occurs at the same extent as in conventional lamps. Therefore, blackening of the arc tube of the mercury-free metal halide lamp proceeds to the same extent as in lamps containing mercury, thereby obtaining the durability that is as long as about 2000 hours, which is equivalent to those of the lamps containing mercury.

As described above, according to an embodiment of the metal halide lamp, a continuous spectrum can be produced by indium over the entire visible wavelength range. In addition, the lamp efficiency and correlated color temperature can be appropriately controlled by setting the electric power load per unit volume of the discharge space and the indium iodide density so as to satisfy the condition given by the above equation (1). The mercury-free metal halide lamp can thereby be obtained, which is suitable for use in, for example, data projectors, automobile lamps, headlights, and the like.

Further, according to the metal halide lamp of the embodiment, as shown in its emission spectrum distribution in FIG. 4, the difference between a peak light intensity and a light intensity between the peaks can be small. A uniform emission distribution, in which the intensity distribution depends less on wavelength, can also be obtained in the visible range. A mercury-free metal halide lamp that is excellent for use as a white light source can thus be obtained. In particular, the peak intensity around 590 nm is less than 1.2 times the peak intensity around 460 nm, so the emission spectrum in FIG. 4 has an advantage of the small peak intensity difference in comparison with the spectrum distribution of the lamp containing three kinds of metal halides having different emission wavelengths, described in FIG. 2 of the above Japanese Patent Laid-Open Publication No. 2000-90880.

EXAMPLE

An example of the invention will now be described.

In a mercury-free metal halide lamp having the same structure as in FIG. 1, the arc tube was fabricated such that: the discharge space volume (V) was set to 25 $mm^3$; the distance between the pair of electrodes 3 was set to 2.5 mm; the diameter of the electrodes 3 was set to 0.3 mmϕ; the xenon gas pressure was set to 10 atm at room temperature; and the quantity (X) of indium iodide (InI) was set to 1000 μg. The electrodes 3 were made of tungsten, and the metal foils 4 were made of molybdenum.

When this arc tube was driven at 50 W, the value of $(P/V)(X/V)^{0.2}$ was 4.18, thus satisfying the condition given by the equation (1). The main characteristics included a lamp voltage of 35.9 V, a lamp efficiency of 59.7 lm/W, a correlated color temperature of 4630 K, and an average color rendering index Ra of 88, thus exhibiting excellent characteristics as a white light source. Further, the lamp current was 1.39 A, which is substantially equivalent to that of conventional lamps containing mercury. The emission spectrum was similar to the one at P/V=2.0 in FIG. 4, the pattern of which was close to the balanced spectrum of natural light, thus obtaining an excellent white light source.

With the same structure as described above, arc tubes having different distances between the electrodes were fabricated and their characteristics were checked. As a result, although the lamp voltages varied in proportion to the distances between the electrodes, substantially identical emission characteristics were obtained. A possible reason for this is that the vapor pressure of indium iodide is higher than those of conventionally used halides such as sodium iodide and scandium iodide, so the tube is hardly affected by the variation of the temperature distribution on its wall. This implies that changing the distance between the electrodes 3 allows for a wide range of design possibilities and therefore a wide range of applications from general illumination to precise optical systems.

While there has been described what are at present considered to be some preferred and exemplary embodiments of the invention, it will be understood that various modifications may be made thereto, and it is intended that the appended claims cover all such modifications as fall within the true spirit and scope of the invention.

What is claimed is:

1. A mercury-free metal halide lamp comprising:

an arc tube having a discharge space not containing mercury;

a pair of electrodes projecting into the discharge space and substantially facing each other;

xenon gas having a pressure of at least 3 atmospheres at room temperature located in the discharge space; and at least a metal halide including monovalent indium iodide located in the discharge space, wherein a relationship $(P/V)(X/V)^{0.2}>3.0$ is satisfied where V represents the volume of the discharge space in $mm^3$, P represents the electric power applied to the arc tube in W, and X represents the weight of the monovalent indium iodide in μg, and a substantially continuous emission spectrum is produced over the entire visible wavelength range.

2. The mercury-free metal halide lamp according to claim 1, wherein:

$$1.6 \leqq (P/V) \leqq 2.4; \text{ and}$$

$$20 \leqq (X/V) \leqq 60.$$

3. The mercury-free metal halide lamp according to claim 2, wherein:

$$1.8 \leqq (P/V) \leqq 2.4;$$

$$20 \leqq (X/V) \leqq 40; \text{ and}$$

$$(P/V)(X/V)^{0.2}>3.6.$$

4. The mercury-free metal halide lamp according to claim 1, wherein the substantially continuous emission spectrum is produced by indium over the entire visible wavelength range.

5. The mercury-free metal halide lamp according to claim 1, wherein the lamp is a vehicle lamp.

6. The mercury-free metal halide lamp according to claim 1, wherein the lamp is a data projector lamp.

7. A mercury-free metal halide lamp comprising:

an arc tube having a discharge space defining a particular volume and not containing mercury;

a pair of electrodes projecting into the discharge space and substantially facing each other such that a particular power of electricity can be applied to the pair of electrodes;

xenon gas having a pressure of at least 3 atmospheres at room temperature located in the discharge space; and at least a metal halide including a particular weight of monovalent indium iodide located in the discharge space, wherein the volume of the discharge space, the electric power applied to the arc tube, and the weight of the monovalent indium iodide are configured such that a substantially continuous emission spectrum is produced over the entire visible wavelength range by the lamp.

8. The mercury-free metal halide lamp according to claim 7, wherein a relationship $(P/V)(X/V)^{0.2}>3.0$ is satisfied where V represents the volume of the discharge space in $mm^3$, P represents the electric power applied to the arc tube in W, and X represents the weight of the monovalent indium iodide in μg.

9. The mercury-free metal halide lamp according to claim 7, wherein:

$$1.6 \leqq (P/V) \leqq 2.4; \text{ and}$$

$20 \leqq (X/V) \leqq 60$, where V represents the volume of the discharge space in $mm^3$, P represents the electric power applied to the arc tube in W, and X represents the weight of the monovalent indium iodide in μg.

10. The mercury-free metal halide lamp according to claim 8, wherein:

$$1.8 \leqq (P/V) \leqq 2.4;$$

$$20 \leqq (X/V) \leqq 40; \text{ and}$$

$$(P/V)(X/V)^{0.2}>3.6.$$

11. The mercury-free metal halide lamp according to claim 7, wherein the substantially continuous emission spectrum is produced by indium over the entire visible wavelength range.

12. The mercury-free metal halide lamp according to claim 7, wherein the lamp is a vehicle lamp.

13. The mercury-free metal halide lamp according to claim 7, wherein the lamp is a data projector lamp.

14. A mercury-free metal halide lamp comprising:

an arc tube having a discharge space defining a particular volume V and not containing mercury;

a pair of electrodes projecting into the discharge space and substantially facing each other;

xenon gas having a pressure of at least 3 atmospheres at room temperature located in the discharge space; and at least a metal halide including a particular weight X of monovalent indium iodide located in the discharge space, wherein the volume V in $mm^3$ of the discharge space and the weight X in μg of the monovalent indium iodide are configured such that $20 \leqq (X/V) \leqq 60$.

15. The mercury-free metal halide lamp according to claim 14, wherein a substantially continuous emission spectrum is produced over the entire visible wavelength range by the lamp.

16. The mercury-free metal halide lamp according to claim 14, wherein a relationship $(P/V)(X/V)^{0.2} > 3.0$ is satisfied where V represents the volume of the discharge space in $mm^3$, P represents the electric power applied to the arc tube in W, and X represents the weight of the monovalent indium iodide in μg.

17. The mercury-free metal halide lamp according to claim 16, wherein:

$$1.6 \leqq (P/V) \leqq 2.4; \text{ and}$$

$$20 \leqq (X/V) \leqq 60.$$

18. The mercury-free metal halide lamp according to claim 17, wherein:

$$1.8 \leqq (P/V) \leqq 2.4;$$

$$20 \leqq (X/V) \leqq 40; \text{ and}$$

$$(P/V)(X/V)^{0.2} > 3.6.$$

* * * * *